US010939795B2

(12) United States Patent
Persson

(10) Patent No.: US 10,939,795 B2
(45) Date of Patent: Mar. 9, 2021

(54) ESTIMATING WATER FILL RATE IN AN APPLIANCE FOR WASHING AND RINSING GOODS

(71) Applicant: ELECTROLUX APPLIANCES AKTIEBOLAG, Stockholm (SE)

(72) Inventor: David Persson, Stockholm (SE)

(73) Assignee: ELECTROLUX APPLIANCES AKTIEBOLAG, Stockholm (SE)

( * ) Notice: Subject to any disclaimer, the term of this patent is extended or adjusted under 35 U.S.C. 154(b) by 169 days.

(21) Appl. No.: 15/772,234

(22) PCT Filed: Nov. 19, 2015

(86) PCT No.: PCT/EP2015/077131
§ 371 (c)(1),
(2) Date: Apr. 30, 2018

(87) PCT Pub. No.: WO2017/084715
PCT Pub. Date: May 26, 2017

(65) Prior Publication Data

US 2018/0310799 A1 Nov. 1, 2018

(51) Int. Cl.
*A47L 15/42* (2006.01)
*A47L 15/00* (2006.01)

(52) U.S. Cl.
CPC ..... *A47L 15/4244* (2013.01); *A47L 15/0023* (2013.01); *A47L 2401/08* (2013.01);
(Continued)

(58) Field of Classification Search
CPC .. A47L 15/4244; A47L 15/0023; D06F 33/54; D06F 2103/18; D06F 2105/02; D06F 2202/085
See application file for complete search history.

(56) References Cited

U.S. PATENT DOCUMENTS

2003/0188767 A1 10/2003 Durfee
2010/0186772 A1* 7/2010 Hatfield ..... A47L 15/4289 134/18

(Continued)

FOREIGN PATENT DOCUMENTS

EP 0326893 A2 * 8/1989 ..... A47L 15/0023
EP 1 967 121 9/2008

(Continued)

OTHER PUBLICATIONS

EP1967121—Machine Translation (Year: 2008).*

(Continued)

*Primary Examiner* — Marc Lorenzi
(74) *Attorney, Agent, or Firm* — Alston & Bird LLP

(57) ABSTRACT

A method and corresponding appliance for carrying out the method may include detecting insufficient circulation pump pressure or process water flow rate through a circulation pump of the appliance, supplying water to a compartment of the appliance and logging a time period during which the water is supplied to the compartment and increasing the speed of the circulation pump to a target pump speed where the circulation pump pressure or the process water flow rate through the circulation pump has reached a sufficient operational level. The method may include logging at least two circulation pump speeds and a time period during which the water is supplied to the compartment, and estimating the water fill rate based on predetermined difference in compartment process water volume for the logged at least two speeds and the water supply time period.

17 Claims, 8 Drawing Sheets

(52) U.S. Cl.
CPC ..... *A47L 2401/14* (2013.01); *A47L 2501/01* (2013.01); *A47L 2501/05* (2013.01)

(56) References Cited

U.S. PATENT DOCUMENTS

| | | | | |
|---|---|---|---|---|
| 2011/0297189 | A1* | 12/2011 | Gram | A47L 15/0023 134/25.2 |
| 2012/0060875 | A1* | 3/2012 | Fauth | A47L 15/46 134/56 D |
| 2013/0008477 | A1* | 1/2013 | Forst | A47L 15/4229 134/57 D |
| 2013/0048025 | A1* | 2/2013 | Heidel | A47L 15/4217 134/18 |
| 2016/0022113 | A1* | 1/2016 | Ladisa | D06F 39/088 137/10 |

FOREIGN PATENT DOCUMENTS

| | | |
|---|---|---|
| EP | 2 413 106 A1 | 2/2012 |
| WO | WO 2014/111875 | 7/2014 |

OTHER PUBLICATIONS

EP0326893—Machine Translation (Year: 1989).*
International Search Report and Written Opinion for International Application No. PCT/EP2015/077131 dated Jul. 8, 2016, 12 pages.
Search Report for Brazilian Application No. BR112018008151-5 dated Apr. 1, 2020, 4 pages.

* cited by examiner

ESTIMATING WATER FILL RATE IN AN APPLIANCE FOR WASHING AND RINSING GOODS

CROSS-REFERENCE TO RELATED APPLICATIONS

This application is a national stage application filed under 35 U.S.C. § 371 of International Application No. PCT/EP2015/077131 filed Nov. 19, 2015, which application is hereby incorporated by reference in its entirety.

TECHNICAL FIELD

The invention relates to a method of estimating water fill rate in an appliance for washing and rinsing goods, and an appliance performing the method.

BACKGROUND

In a washing appliance such as a dishwasher, sensors are required for monitoring water levels in a compartment of the dishwasher, in particular when supplying water to the compartment via a dishwasher inlet to avoid an overflow situation, or simply to just monitor the approximate water level in the dishwasher. Theses sensors add to the complexity, and thus the cost, of a dishwasher.

EP 1 967 121 discloses involving filling a dishwasher with a ground water amount and increasing a rotational speed of a circulating pump from a starting rotational speed to a target rotational speed. The rotational speed of the circulating pump is increased to a refuelling rotational speed based on the starting rotational speed after the intake of the ground water amount such that an unstable pump run occurs. The water amount is supplied to the dishwasher depending on the refuelling rotational speed or a mathematical relationship between the target rotational speed and refuelling rotational speed.

The problem remains that a water level sensor must be used in order to measure water level in the compartment from which the filing commences.

SUMMARY

An object of the present invention is to solve, or at least mitigate, this problem in the art and to provide a method of estimating water fill rate in an appliance for washing and rinsing goods without using traditional fill rate sensors.

This is attained in a first aspect of the invention by a method of estimating water fill rate in an appliance for washing and rinsing goods. The method comprises detecting insufficient circulation pump pressure or process water flow rate through a circulation pump of the appliance, supplying water to a compartment of the appliance and logging a time period during which the water is supplied to the compartment and increasing the speed of the circulation pump to a target pump speed where the circulation pump pressure or the process water flow rate through the circulation pump has reached a sufficient operational level, the speed being increased at a pace where process water level in a sump of the compartment is maintained or decreased. Further, the method comprises logging, upon increasing the circulation pump speed from a speed where the insufficient circulation pump pressure or process water flow rate was detected, at least two circulation pump speeds and a time period during which the water is supplied to the compartment, wherein at least one of the logged at least two circulation pump speeds is a speed where circulation pump pressure or process water flow rate is insufficient, and estimating the water fill rate based on predetermined compartment process water volumes associated with the logged at least two speeds and the water supply time period.

This is attained in a second aspect of the invention by an appliance for washing and rinsing goods. The appliance comprises a circulation pump, a sensing arrangement arranged to measure an indication of circulation pump pressure or process water flow rate through the circulation pump, an inlet via which water is supplied to a compartment of the appliance, and a controller arranged to control operating speed of the circulation pump and to control the supply of water to the compartment. The controller is further arranged to detect insufficient circulation pump pressure or process water flow rate through the circulation pump of the appliance, supply water to the compartment of the appliance, and increase the speed of the circulation pump to a target pump speed where the circulation pump pressure or the process water flow rate through the circulation pump has reached a sufficient operational level, the speed being increased at a pace where process water level in a sump of the compartment is maintained or decreased. Moreover, the controller is arranged to log, upon increasing the circulation pump speed from a speed where the insufficient circulation pump pressure or process water flow rate was detected, at least two circulation pump speeds and a time period during which the water is supplied to the compartment, wherein at least one of the logged at least two circulation pump speeds is a speed where circulation pump pressure or process water flow rate is insufficient, and to estimate the water fill rate based on predetermined difference in compartment process water volume for the logged at least two speeds and the water supply time period.

Advantageously, by logging a circulation pump speed at which the circulation pump pressure or process water flow rate through the circulation pump is detected to be insufficient, and at least one further pump speed upon increasing the speed to a target speed at which the circulation pump pressure or process water flow rate through the circulation pump is restored at a sufficient level, while supplying additional water to the compartment, it is possible to detect a fill rate for the water being supplied to the compartment of the washing appliance upon detecting insufficient pressure/flow rate. The insufficient level is reached when the flow of process water from the pump exceeds the flow of process water to the pump.

Thus, a circulation pump pressure or process water flow rate through the circulation pump is detected to be insufficient, whereupon additional water is supplied to the compartment in order to restore pressure or process water flow rate while the speed of the circulation pump is increased to a target speed at which the circulation pump pressure or process water flow rate through the circulation pump is restored at a sufficient level.

By logging at least two circulation pump speeds and a time period during which the water is supplied to the compartment during the increase of pump speed, where at least one of the two speeds is a speed at which the circulation pump pressure or process water flow rate through the circulation pump is detected to be insufficient, it is advantageously possible to estimate a fill rate for the water being supplied to the compartment.

Assuming that the speed of the circulation pump at which the circulation pump pressure or process water flow rate through a circulation pump is detected to be insufficient is denoted $v_L$, and the target speed at which the circulation pump pressure or process water flow rate through the circulation pump is restored at a sufficient level is denoted $v_T$, and that a further intermediary speed denoted $v_I$ is detected at which the circulation pump pressure or process water flow rate through a circulation pump again is detected to be insufficient; any two or three of these measuring points can be used to estimate the water fill rate By using a predetermined difference in water volume between for instance $v_L$ and $v_I$, e.g. derived in a test run during development or production of the dishwasher, the controller of the dishwasher may estimate the fill rate.

For example, during the test run, at a first pump speed $v_L$ the flow from the circulation pump suddenly exceeds the flow to the circulation pump; i.e. insufficient circulation pump pressure or process water flow rate is detected, after previously having been considered sufficient.

Water is filled in the compartment and the pump speed is increased, whereupon the pressure or flow rate again is restored, i.e. the flow from the circulation pump no longer exceeds the flow to the circulation pump.

When reaching the second speed $v_I$, insufficient circulation pump pressure or process water flow rate is again detected during the test run. At this point, it can be concluded that a certain amount of water has been supplied to the compartment during the increase in pump speed from the first speed $v_L$, since the fill capacity of a compartment water inlet, and its controlling valve, is known.

Thus, by using the difference in water volume determined during the test run in a normal water fill procedure for speeds speed $v_L$ and $v_I$, and by logging the time period during which water is supplied to the compartment, the fill rate can be estimated.

It should be noted that during the time period ranging from when the water is supplied upon detecting insufficient pressure/flow rate, and up to the reaching of the target speed when the pressure/flow rate again is restored at a sufficient level, a valve of an inlet supplying the water may not be constantly open. In such case, the estimation of the fill rate must take into account the fact that $t_{open}$ is shorter than the time period from detecting insufficient pressure/flow rate to the pressure/flow rate being restored at the target speed.

Advantageously, by using the method of the invention to estimate the fill rate, there is no need to equip the dishwasher with fill rate sensors or water level sensors, as is oftentimes done in the art.

In an embodiment of the invention, at least three circulation pump speeds are logged, and the water fill rate is estimated performing an interpolation using the logged at least three circulation pump speeds. Hence, by using a greater number off logged circulation pump speeds, a more accurate estimation of the water fill rate may advantageously be obtained.

In a further embodiment, selected logged circulation pump speeds are discarded, and two or more remaining circulation pump speeds are used in the estimation after the selected logged circulation pump speeds have been discarded. Advantageously, one or more logged measurement points deviating from a majority of the remaining logged measurement points are discarded for a more accurate estimation of the water fill rate.

In still another embodiment, if the estimated water fill rate exceeds a maximum fill rate of the appliance, the estimated fill rate is advantageously set to equal said maximum fill rate.

In still a further embodiment, the predetermined compartment process water volumes associated with the logged at least two speeds are acquired from a look-up table typically stored in a local memory in connection to the controller of the washing appliance. Advantageously, for any particular type of dishwasher, it can be determined (e.g. during production of the appliance), compartment water volumes associated with the respective circulation pump speeds used for estimating the water fill rate of the appliance In yet an embodiment, insufficient circulation pump pressure or process water flow rate through the circulation pump is detected indirectly by measuring operating current of a motor driving the circulation pump. This may be measured by measuring the voltage of a known shunt resistor in the motor and calculating the current by using Ohm's law. Measured current can be directly translated into circulation pump torque; the higher the torque, the higher the operating current of the motor driving the pump, and a higher pump torque implies a greater flow of process water through the circulation pump. Measuring operating current of the circulation pump motor is in itself advantageous as compared to using a relatively expensive pressure or flow rate sensor to measure the pump pressure or flow of process water through the pump. With the measured operating current, it can be determined whether the pressure or flow is insufficient, or whether it has been restored to a sufficient level.

Generally, all terms used in the claims are to be interpreted according to their ordinary meaning in the technical field, unless explicitly defined otherwise herein. All references to "a/an/the element, apparatus, component, means, step, etc." are to be interpreted openly as referring to at least one instance of the element, apparatus, component, means, step, etc., unless explicitly stated otherwise. The steps of any method disclosed herein do not have to be performed in the exact order disclosed, unless explicitly stated.

BRIEF DESCRIPTION OF THE DRAWINGS

The invention is now described, by way of example, with reference to the accompanying drawings, in which.

DETAILED DESCRIPTION

The invention will now be described more fully hereinafter with reference to the accompanying drawings, in which certain embodiments of the invention are shown. This invention may, however, be embodied in many different forms and should not be construed as limited to the embodiments set forth herein; rather, these embodiments are provided by way of example so that this disclosure will be thorough and complete, and will fully convey the scope of the invention to those skilled in the art. Like numbers refer to like elements throughout the description. The washing appliance of the invention will subsequently be exemplified by a dishwasher.

Figure 1:
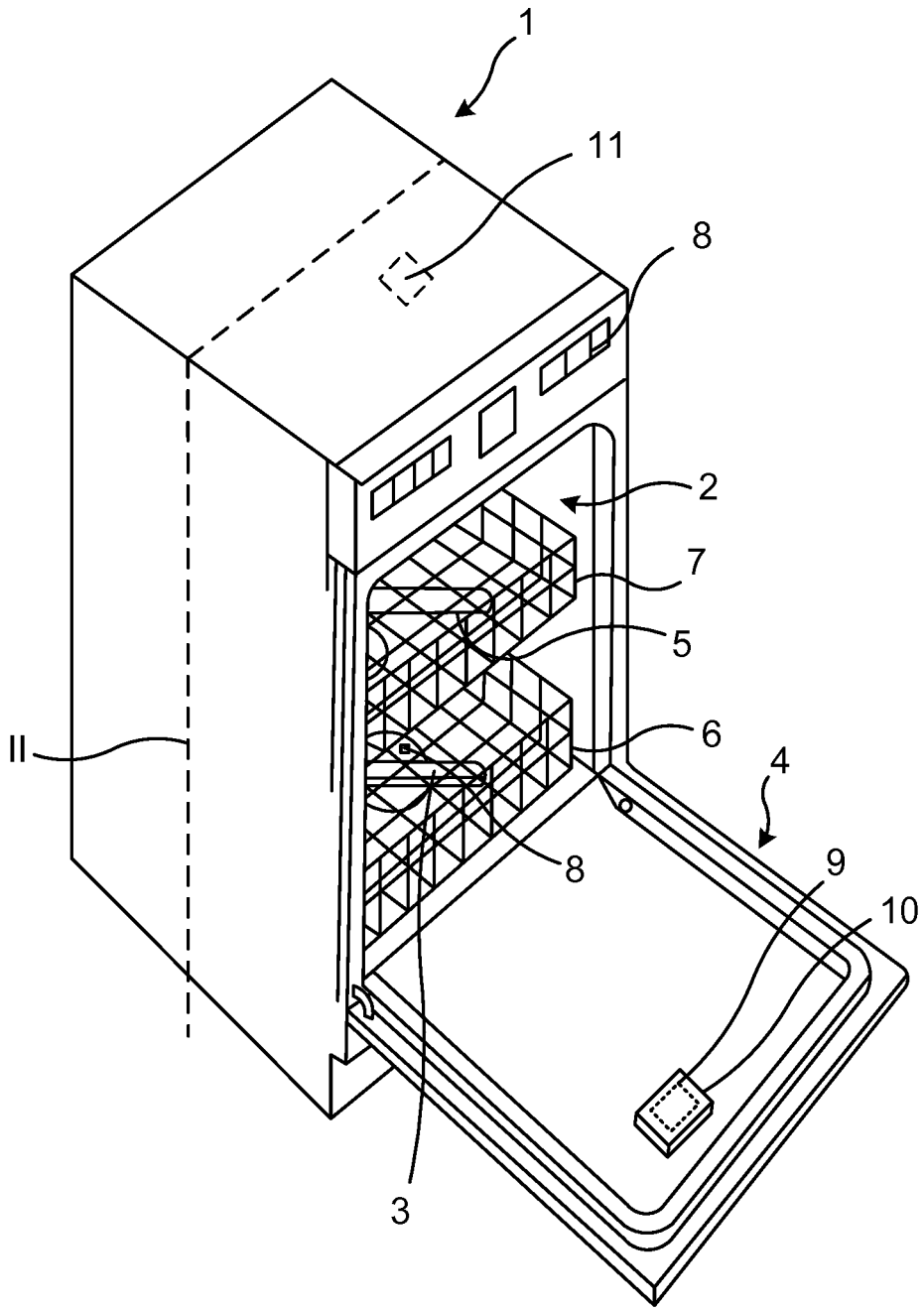
FIG. 1 shows a prior art dishwasher in which the present invention can be implemented.

FIG. 1 shows a prior art dishwasher 1 in which the present invention can be implemented. It should be noted that dishwashers can take on many forms and include many different functionalities. The dishwasher 1 illustrated in FIG. 1 is thus used to explain different embodiments of the present invention and should only be seen as an example of a dishwasher in which the present application can be applied.

The exemplifying dishwasher 1 comprises a washing compartment or tub 2, a door 4 configured to close and seal the washing compartment 2, a spraying system having a lower spray arm 3 and an upper spray arm 5, a lower rack 6 and an upper rack 7. Additionally, it may comprise a specific top rack for cutlery (not shown). A controller 11 such as a microprocessor is arranged in the interior of the dishwasher for controlling washing programmes and is communicatively connected to an interface 8 via which a user can select washing programmes.

The door 4 of the prior art dishwasher 1 illustrated in FIG. 1 is further on its inside arranged with a small detergent dispenser 9 having a lid 10 being controllably opened and closed by the controller 11 for dispensing detergent from the dispenser 9 into the tub 2.

Figure 2:
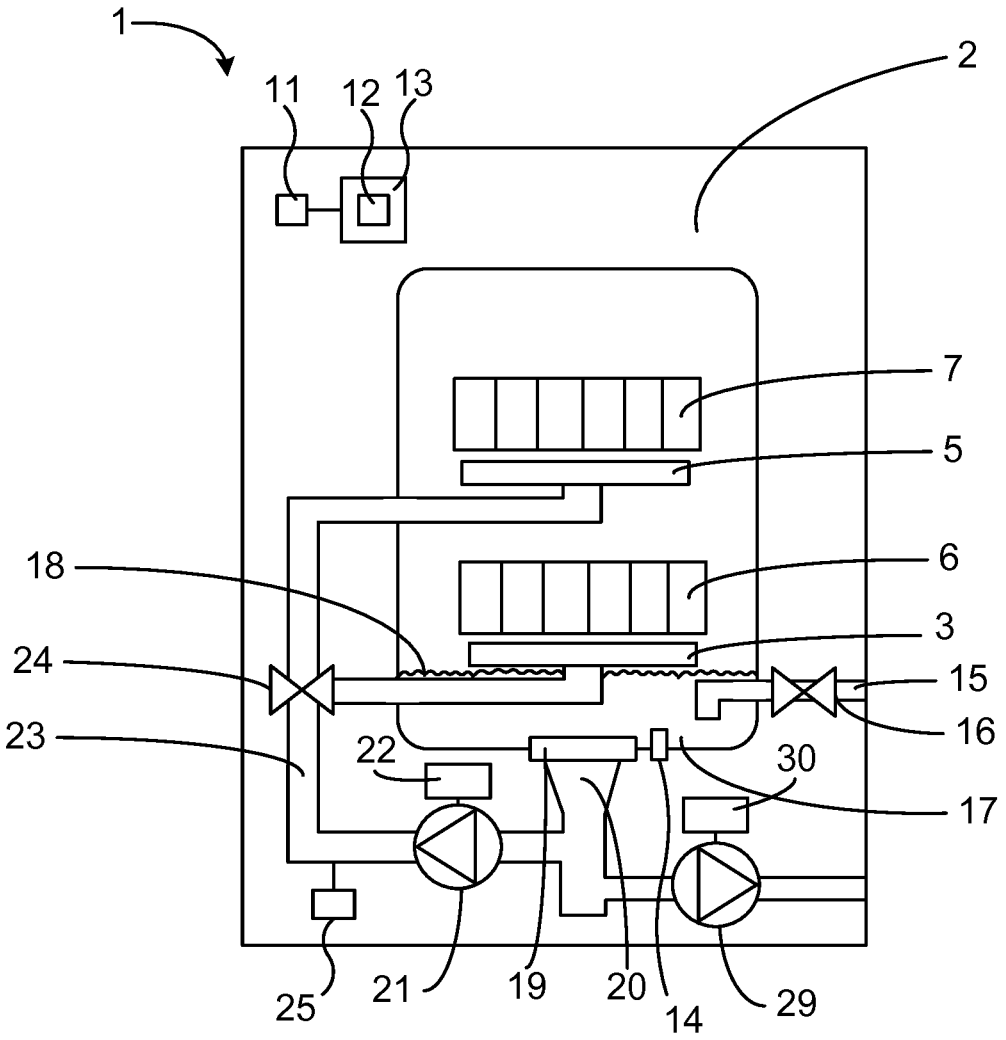
FIG. 2 schematically illustrates a cross-sectional view of the dishwasher of FIG. 1 taken along section II.

FIG. 2 schematically illustrates a cross-sectional view of the dishwasher 1 of FIG. 1 taken along section II, to further illustrate components included in a dishwasher 1. Hence, as previously mentioned, the dishwasher 1 comprises a washing compartment or tub 2 housing an upper basket 7 and a lower basket 6 for accommodating goods to be washed such as cutlery, plates, drinking-glasses, trays, etc.

Detergent in the form of liquid, powder or tablets is dosed in a detergent compartment located on the inside of a door (not shown in FIG. 2) of the dishwasher 1 by a user, which detergent is controllably discharged into the washing compartment 2 in accordance with a selected washing programme. As previously mentioned, the operation of the dishwasher 1 is typically controlled by the controller 11 executing appropriate software 12 stored in a memory 13.

Fresh water is supplied to the washing compartment 2 via water inlet 15 and water supply valve 16. This fresh water is eventually collected in a so called sump 17, where the fresh water is mixed with the discharged detergent resulting in process water 18. The opening and closing of the water supply vale 16 is typically controlled by the controller 11.

By the expression "process water" as used herein, is meant a liquid containing mainly water that is used in and circulates in a dishwasher. The process water is water that may contain detergent and/or rinse aid in a varying amount. The process water may also contain soil, such as food debris or other types of solid particles, as well as dissolved liquids or compounds. Process water used in a main wash cycle is sometimes referred to as the wash liquid. Process water used in a rinse cycle is sometimes referred to as cold rinse or hot rinse depending on the temperature in the rinse cycle. The pressurized fluid supplied to the detergent dispensing device according to embodiments of the invention thus at least partly contains process water.

At the bottom of the washing compartment is a filter 19 for filtering soil from the process water before the process water leaves the compartment via process water outlet 20 for subsequent re-entry into the washing compartment 2 through circulation pump 21. Thus, the process water 18 passes the filter 19 and is pumped through the circulation pump 21, which typically is driven by a brushless direct current (BLDC) motor 22, via a duct 23 and process water valve 24 and sprayed into the washing compartment 2 via nozzles (not shown) of a respective wash arm 3, 5 associated with each basket 6, 7. Thus, the process water 18 exits the washing compartment 2 via the filter 19 and is recirculated via the circulation pump 21 and sprayed onto the goods to be washed accommodated in the respective basket via nozzles of the wash arms 3, 5. Further, a controllable heater 14 is typically arranged in the sump 17 for heating the process water 18.

The washing compartment 2 of the dishwasher 1 is drained on process water 18 with a drain pump 29 driven by a BLDC motor 30. It should be noted that it can be envisaged that the drain pump 29 and the circulation pump 21 may be driven by one and the same motor.

A sensing arrangement 25 may be arranged at the circulation pump 21 for measuring flow rate of the process water 18 passing through the circulation pump 21, or the pressure of the circulation pump 21. The sensing arrangement may be embodied in the form of a pressure or flow rate transducer. Alternatively, the sensing arrangement 25 may be implemented in the form of a resistor arranged at the circulation pump motor 22 for measuring operation current of the motor. Practically, this is undertaken by measuring the operating voltage of a known shunt resistor in the motor 22 of the circulation pump 21 and calculating the operating current. From the measured current, it is determined whether the pressure/flow rate is sufficient or not.

Figure 3A:
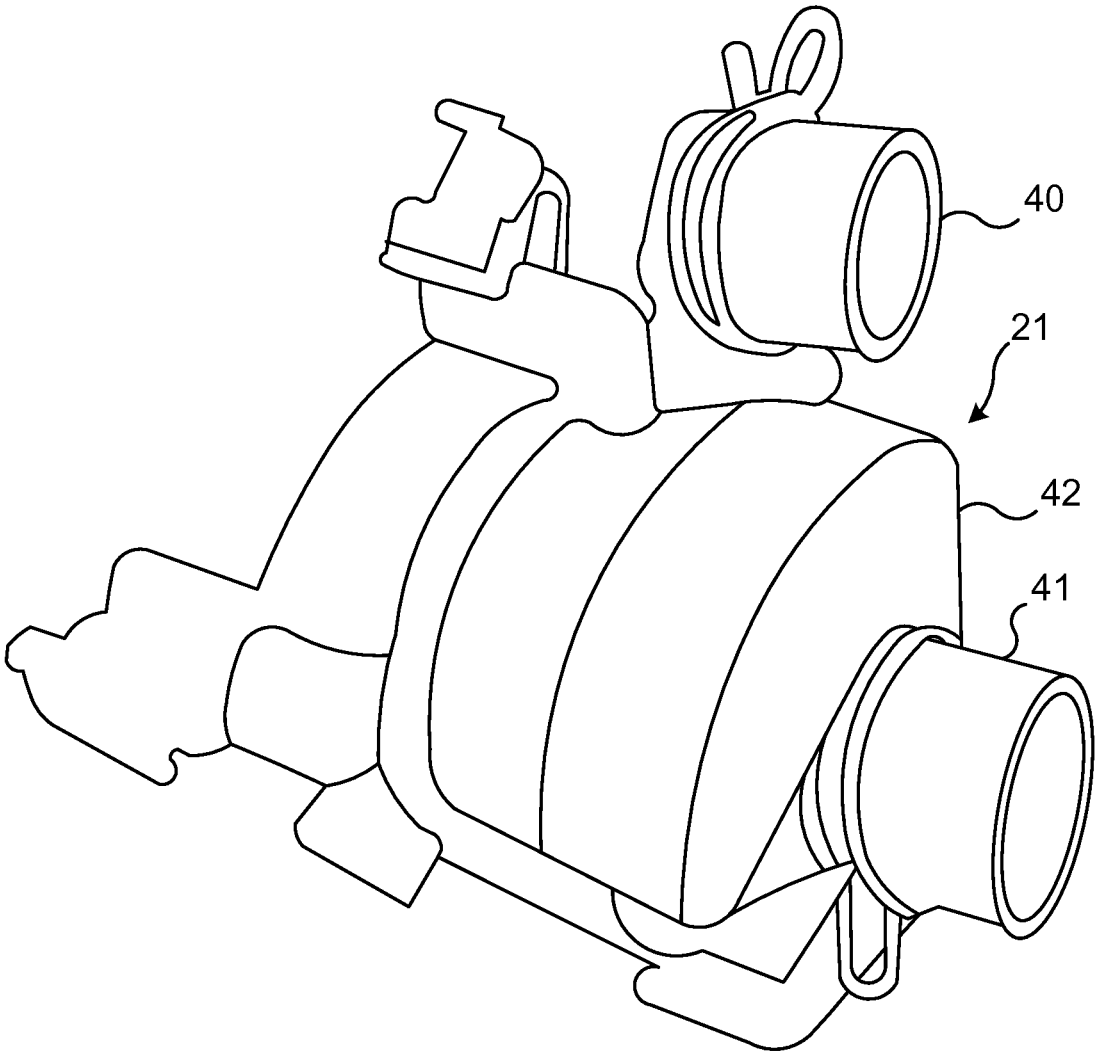
FIGS. 3*a* and *b* illustrate two different views of a circulation pump which can be controlled according to embodiments of the present invention.

FIG. 3*a* shows a view of an exemplifying circulation pump 21. The speed of the circulation pump 21 is typically controlled by the controller 11. FIG. 3*a* shows an outlet 40 (referred to as a discharge port) of the circulation pump 21 and an inlet 41. The casing 42 of the circulation pump 21 is referred to as the volute and can be removed from a main body 43 of the circulation pump 21.

Figure 3B:
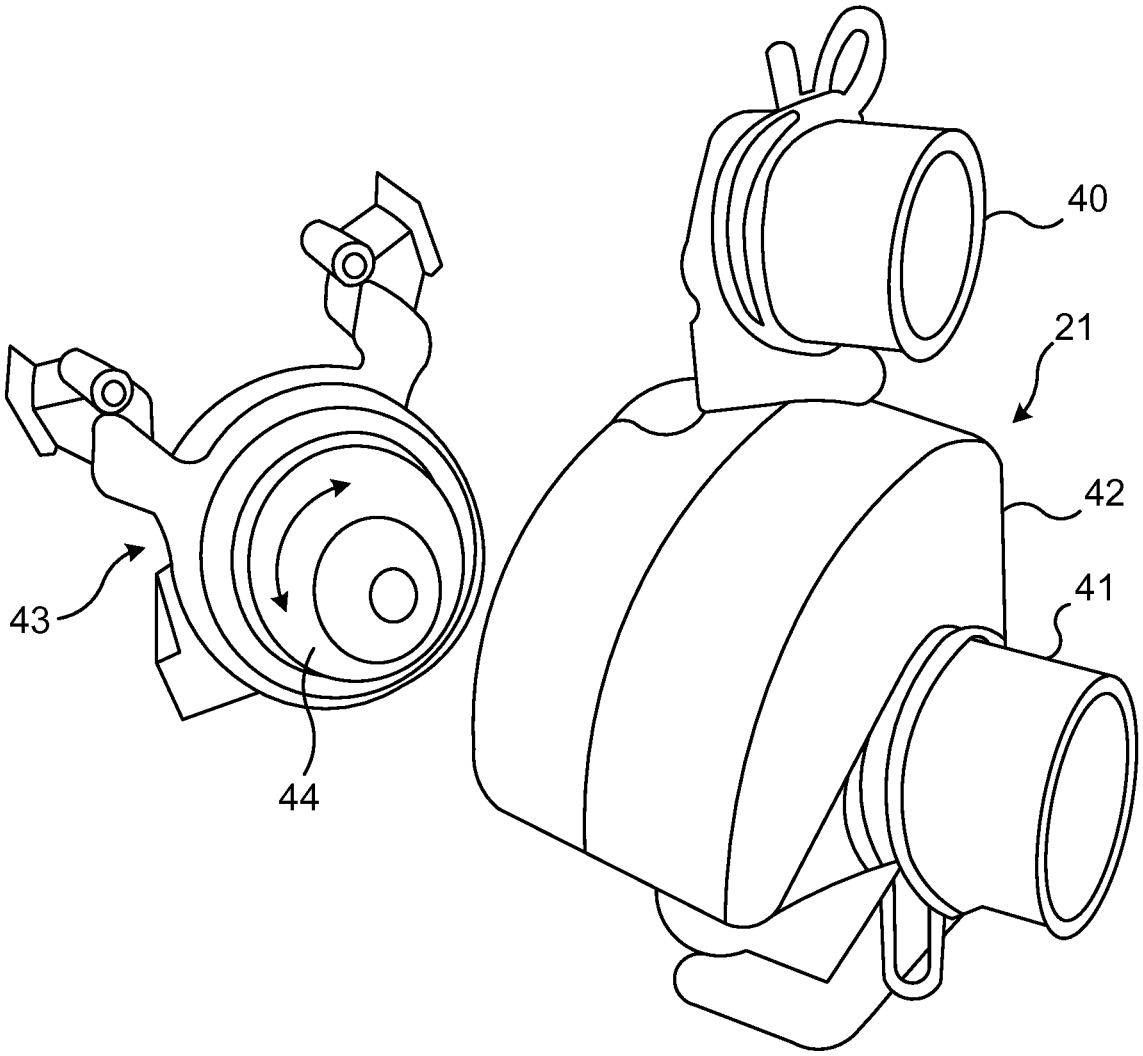

FIG. 3*b* shows a further view of the circulation pump 21 of FIG. 3*a*, where the volute 42 has been removed from the main body 43 of the circulation pump, thereby revealing the impeller 44 of the circulation pump which under operation pumps the process water that is entering the circulation pump 21 via the inlet 41. The process water that is pumped by the impeller 44 is subsequently received by the volute 42, which slows down the flow rate of the process water, and exits the circulation pump 21 via the outlet 40.

Now, as previously has been mentioned, where the process water 18 flowing to the circulation pump 21 is in contact with vacuum or any gas, for instance via an evaporator, a lower flow of process water to the pump 21 than from the pump will eventually cause a pressure loss due to vacuum or gas inside the pump 21.

This loss of pressure or flow rate is restored to a sufficient level by supplying water to the compartment 2 via inlet 15 controlled by valve 16.

Figure 4:
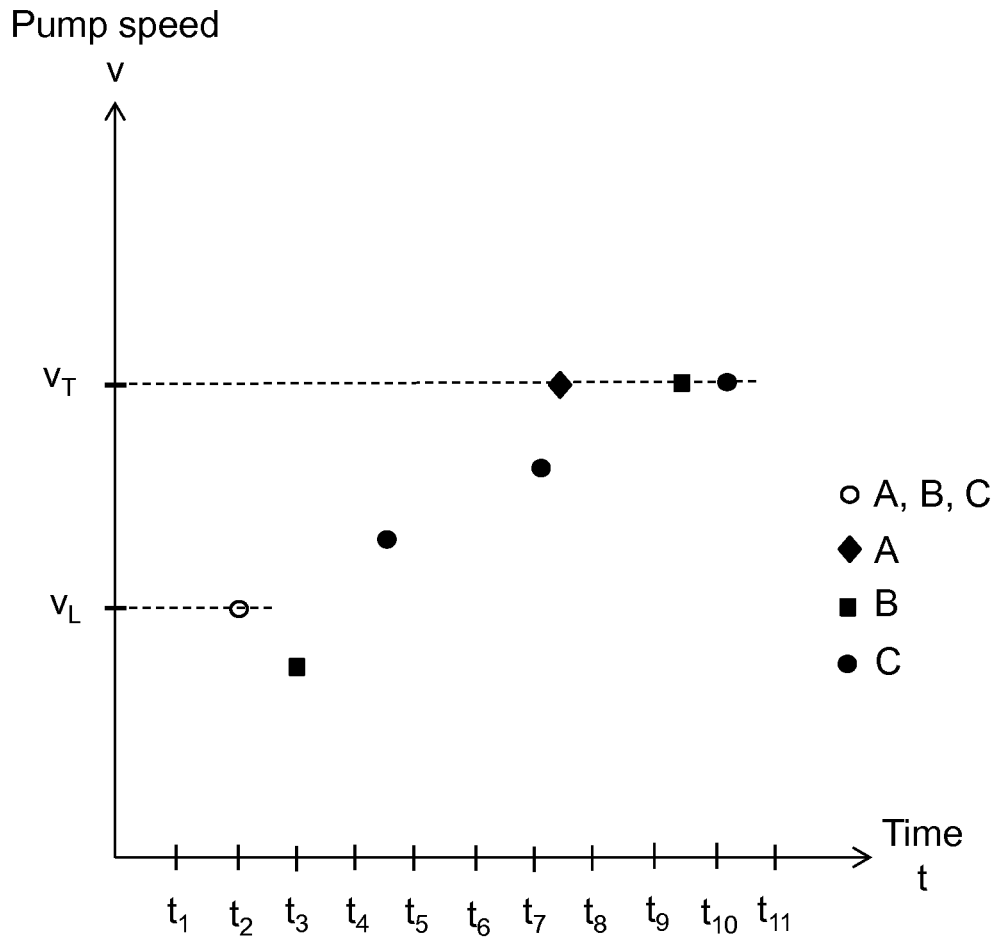
FIG. 4 shows four different scenarios of restoring pressure or flow rate for estimating water fill rate in a dishwasher according to the invention.

FIG. 4 illustrates three different scenarios that will be discussed in detail in the following. In FIG. 4, the three different scenarios all have the same starting point at time $t_{2v}$ with respect to circulation pump speed $v_S$ where the pressure of the circulation pump 21 or process water flow rate through the circulation pump 21 is detected to be insufficient, from having been at a sufficient level. In practice, the starting point may vary in both speed and time.

Further, in this particular example, all three scenarios has the same target speed $v_T$ where the pressure of the circulation pump 21 or process water flow rate through the circulation pump 21 is restored to a sufficient level after water has been supplied to the compartment 2. Again, in practice, the target speed may vary depending on type of dishwasher, type of washing programme, and which phase a selected washing programme is in.

In each scenario, all points between the starting point $v_S$ and the target point $v_T$ represent pump speeds where the pressure of the circulation pump 21 or process water flow rate through the circulation pump 21 is detected to be insufficient, i.e. where the flow from the pump exceeds the flow to the pump.

In Scenario A, only starting point $v_S$ and the target point $v_T$ is logged.

In Scenario B, a first attempt to restore the pressure/flow rate by supplying the water is unsuccessful. Thus, a further point where the pressure of the circulation pump 21 or process water flow rate through the circulation pump 21 is detected to be insufficient is logged at time $t_3$.

In Scenario C, four points are logged along a straight line.

Figure 5A:
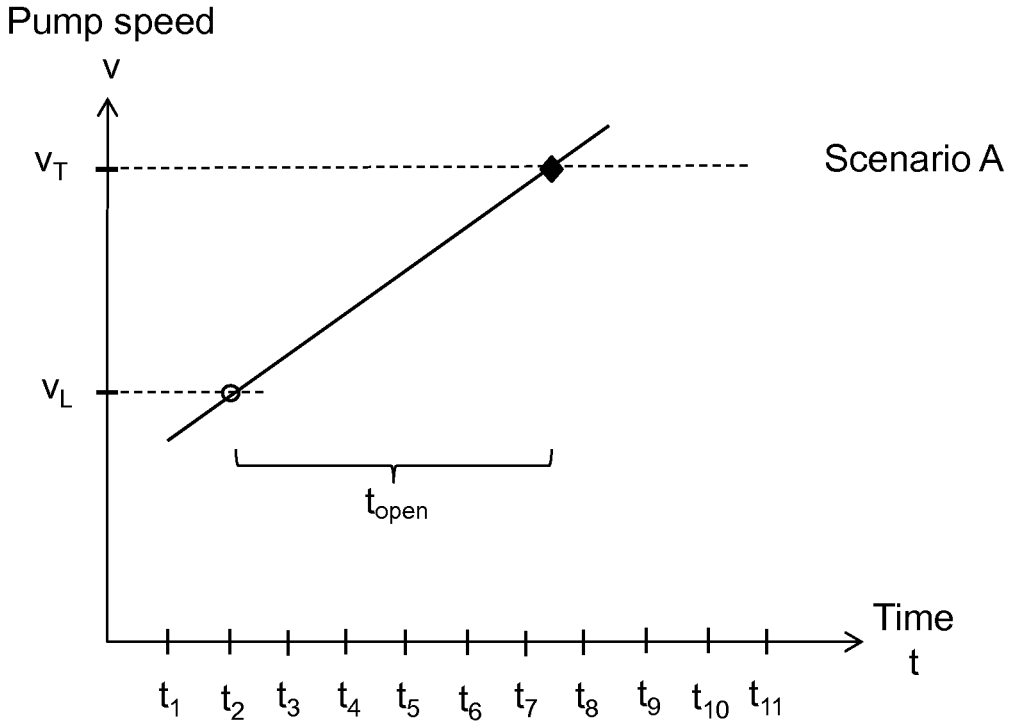
FIG. 5*a* illustrates an embodiment of estimating the water fill rate in Scenario A of FIG. 4.
Figure 5B:
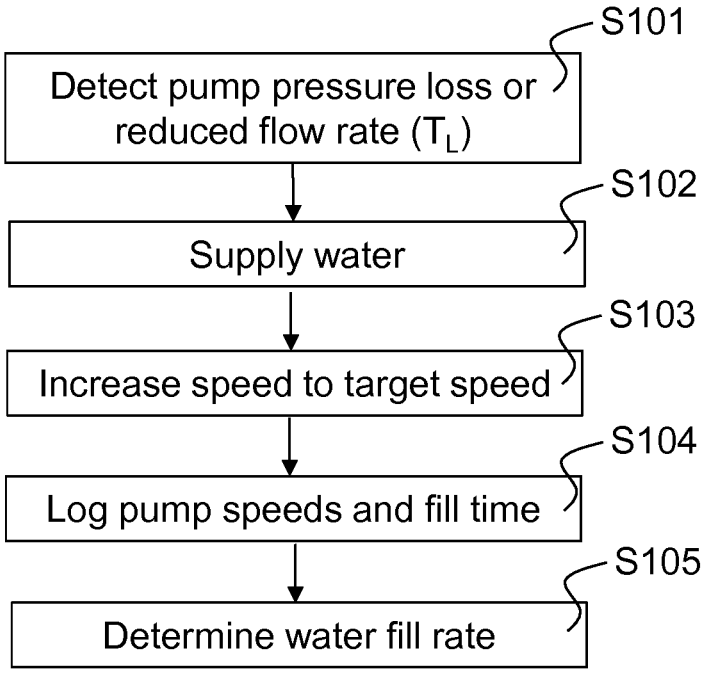
FIG. 5*b* shows a flowchart illustrating an embodiment of a method of estimating the water fill rate in a dishwasher according to the invention.

FIG. 5*a* shows Scenario A occurring and FIG. 5*b* illustrates a flowchart over an embodiment of the method of estimating water fill rate in a dishwasher according to the invention when Scenario A occurs.

Hence, the controller 11 detects in step S101, via the sensing arrangement 25, insufficient circulation pump pressure or process water flow rate through the circulation pump 21 of the dishwasher 1. This is illustrated in FIG. 5*a* to occur at a pump speed $v_L$.

This may detected by reading a pressure or flow rate transducer, or as is performed in an embodiment of the invention, by measuring the operating voltage of a known shunt resistor in the motor 22 of the circulation pump 21 and calculating the operating current. From the measured current, it is determined whether the pressure/flow rate is sufficient or not.

Measured current can be directly translated into circulation pump torque; the higher the torque, the higher the operating current of the motor 22 driving the pump 21, and a higher pump torque implies a greater flow of process water through the circulation pump. When the operating current decreases to a particular level, it can thus be deducted that the process water flow from the pump exceeds the flow of process water to the pump, thereby indicating an insufficient flow rate.

Upon detecting the insufficient pressure or flow rate of the circulation pump 21, the controller 11 controls the valve 15 of the fresh water inlet 16 to supply additional water to the compartment 2 of the dishwasher 1. It should be noted that this example illustrates water being supplied from outside the dishwasher 1. However, it can alternatively be envisaged that water is supplied from a storage tank (not shown) inside the dishwasher.

The speed of the circulation pump 21 is increased in step S103 to a target pump speed $v_T$ where the circulation pump pressure or the process water flow rate through the circulation pump has reached a sufficient operational level. That is, the pump speed is increased to a target speed $v_T$ where the process water flow to the pump is equal to, or exceeds, the flow of process water from the pump 21, thereby restoring pressure/flow rate of the circulation pump 21. The speed is increased at a pace where process water level in the sump 17 of the compartment 2 of the dishwasher 1 is maintained or decreased.

Now, upon increasing the circulation pump speed from a speed $v_L$ where the insufficient circulation pump pressure or process water flow rate was detected, the controller 11 will in step S104 log at least two circulation pump speeds and a time period $t_{open}$ during which the water is supplied to the compartment 2 via the valve 15 and the inlet 16. Of the logged pump speeds, at least one circulation pump speed is a speed where circulation pump pressure or process water flow rate is insufficient.

The logged speeds will, together with a filling time period during which water is supplied to the compartment, subsequently be used for determining a fill rate.

To this end, a predetermined difference in compartment process water volume for the logged (at least two) speeds is utilized. This is illustrated in Table 1 below, which table for instance may be derived during a test run in a development or production phase of the dishwasher. It should be noted that in practice, a higher resolution would typically be used, such as a volume value given each 50 rpm.

TABLE 1

| Pump Speed (rpm) | Volume |
|---|---|
| $v_1$ = 1800 | X |
| $v_2$ = 2000 | X + 0.41 |
| $v_3$ = 2200 | X + 0.91 |
| $v_4$ = 2400 | X + 1.41 |
| $v_T$ = 2600 | X + 2.01 |

Hence, at a first pump speed $v_1$=1800 revolutions per minute (rpm), the flow from the circulation pump suddenly exceeds the flow to the circulation pump; i.e. insufficient circulation pump pressure or process water flow rate is detected, after previously having been considered sufficient.

Water is filled by having the controller 11 control the valve 16 of the inlet 15, whereupon the pressure or flow rate again is restored, i.e. the flow from the circulation pump no longer exceeds the flow to the circulation pump, and the pump speed is increased. As has previously has been discussed, the speed is increased at a pace where process water level in the sump of the compartment of the dishwasher is maintained or decreased.

When reaching a second speed $v_2$=2000 rpm, insufficient circulation pump pressure or process water flow rate is again detected. At this point, it is logged that 0.4 l water has been supplied to the compartment during the increase in pump speed from the first speed $v_1$, since the fill capacity of the valve 16 and inlet 15 is known.

Finally, a target speed $v_T$ is reached, at which target speed the pressure/flow rate should be restored. In this particular example, 2 l of water has been supplied to the compartment since the pump speed was increased from speed $v_1$ at which insufficient pressure/flow rate first was detected. The data of Table 1 can be used to estimate the water fill rate as will be described.

Again with reference to the exemplifying embodiment illustrated in FIG. 5*a*—showing Scenario A—only pump speeds $v_L$ and $v_T$ are logged. In such a scenario, there is enough water in the compartment for maintaining a sufficient pressure or flow rate at any speed from $v_L$ up to the target speed $v_T$. No further water will be supplied to the compartment, and a fill rate equal to a maximum fill rate will be assumed in step S105, say for instance 2.5 l/min.

In an embodiment of the invention, the compartment water volumes associated with the respective logged circulation pump speeds acquired for instance during production of the dishwasher 1, is stored as a look-up table in memory, where each speed maps to a particular compartment water volume.

Figure 6:
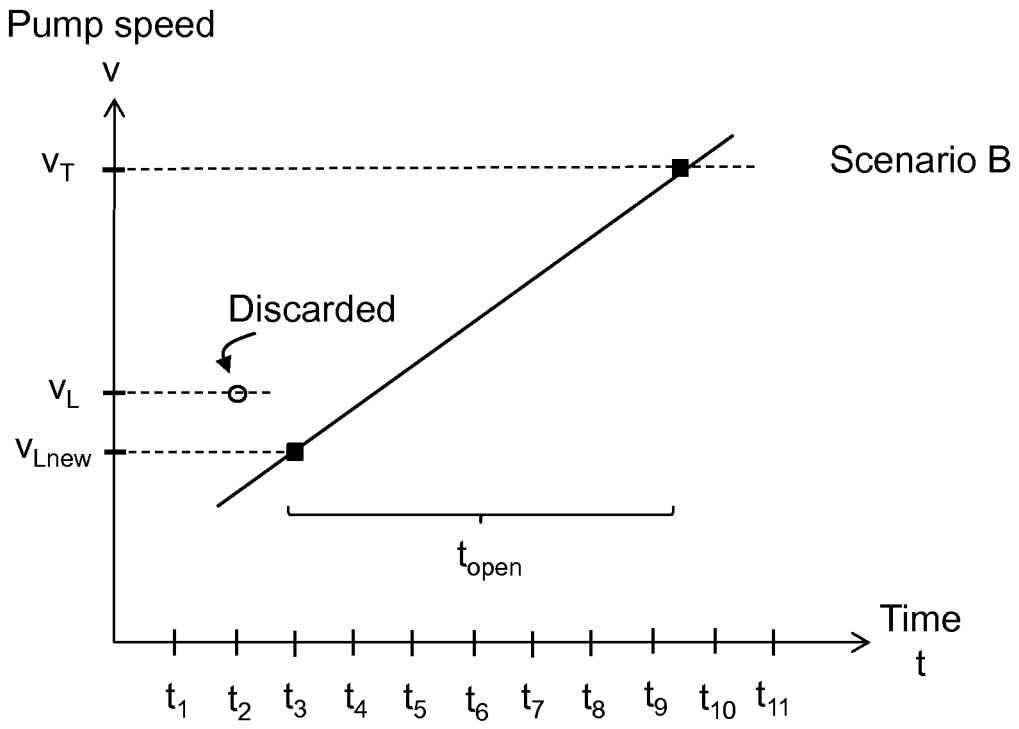
FIG. 6 illustrates an embodiment of estimating the water fill rate in Scenario B of FIG. 4.

FIG. 6 illustrates Scenario B that previously has been discussed with reference to FIG. 4. Again, the controller 11 detects insufficient circulation pump pressure or process water flow rate through the circulation pump 21 of the dishwasher 1 in step S101 at a pump speed $v_L$, which in this particular exemplifying embodiment is assumed to correspond to $v_2$=2000 rpm in Table 1.

Upon detecting the insufficient pressure or flow rate of the circulation pump 21, the controller 11 controls the valve 15 of the fresh water inlet 16 to supply additional water to the compartment 2 of the dishwasher 1 in step S102. The pressure or flow rate is again restored.

The speed of the circulation pump 21 is increased in step S103 to a target pump speed $v_T$ where the circulation pump pressure or the process water flow rate through the circulation pump has reached a sufficient operational level.

Now, upon increasing the circulation pump speed from a speed $v_L=v_2$ where the insufficient circulation pump pressure or process water flow rate was detected, the controller 11 will in step S104 log at least two circulation pump speeds and a time period $t_{open}$ during which the water is supplied to the compartment 2 via the valve 15 and the inlet 16. Of the logged pump speeds, at least one circulation pump speed is a speed where circulation pump pressure or process water flow rate is insufficient. In a general case, all logged speeds except the target speed are speeds where circulation pump pressure or process water flow rate is detected to be insufficient.

In this particular exemplifying embodiment, upon supplying water to the compartment 2, the speed of the circulation pump 21 initially decreases to a speed $v_{Lnew}=v_1$ where the pressure/flow rate still is insufficient, before the pump ultimately reaches the target speed $v_T$.

A number of different methodologies with respect to e.g. interpolation may be envisaged for estimating the water fill rate. In this embodiment, it is determined that the first logged speed $v_L=v_2$ is discarded.

In step S105, the controller 11 estimates, the rate with which the water is supplied to the compartment 2 as:

$$\text{fill rate} = \frac{V(v_T) - V(v_{Lnew})}{t_{open}},$$

where $t_{open}$ is the filling time period

Using numerical examples exemplified in Table 1:

$v_{Lnew}=v_1$=1800 rpm=>$V(v_{Lnew})=X$, $v_T$=2600 rpm=>$V(v_T)=X$+2.0 l, and $t_{open}$=60 seconds, the fill rate will be estimated to:

$$\text{fill rate} = \frac{X + 2.0 - X}{60} = 2 \text{ l/min.}$$

Advantageously, by using the method of the invention to estimate the fill rate, there is no need to equip the dishwasher 1 with fill rate sensors or water level sensors, as is done in the art. Alternatively, with respect to FIG. 7, instead of discarding the point at speed $v_L=v_2$, that point is used for estimating the fill rate.

Using numerical examples exemplified in Table 1:

$v_L=v_2$=2000 rpm=>$V(v_L)=X$+0.4 l, $v_T$=2600 rpm=>$V(v_T)=X$+2.0 l, and $t_{open}$=75 seconds, the fill rate will be estimated to:

$$\text{fill rate} = \frac{X + 2.0 - (X + 0.4)}{75} = 1.28 \text{ l/min.}$$

In an embodiment, an interpolation is performed using all three logged points. Various methods of performing interpolation are known in the art. Which one to use depends on numerous factors such as type of dishwasher 1, how the motor 22 of the circulation pump 21 is controlled, the physical path of the process water 18 circulating in the system, etc.

Figure 7:
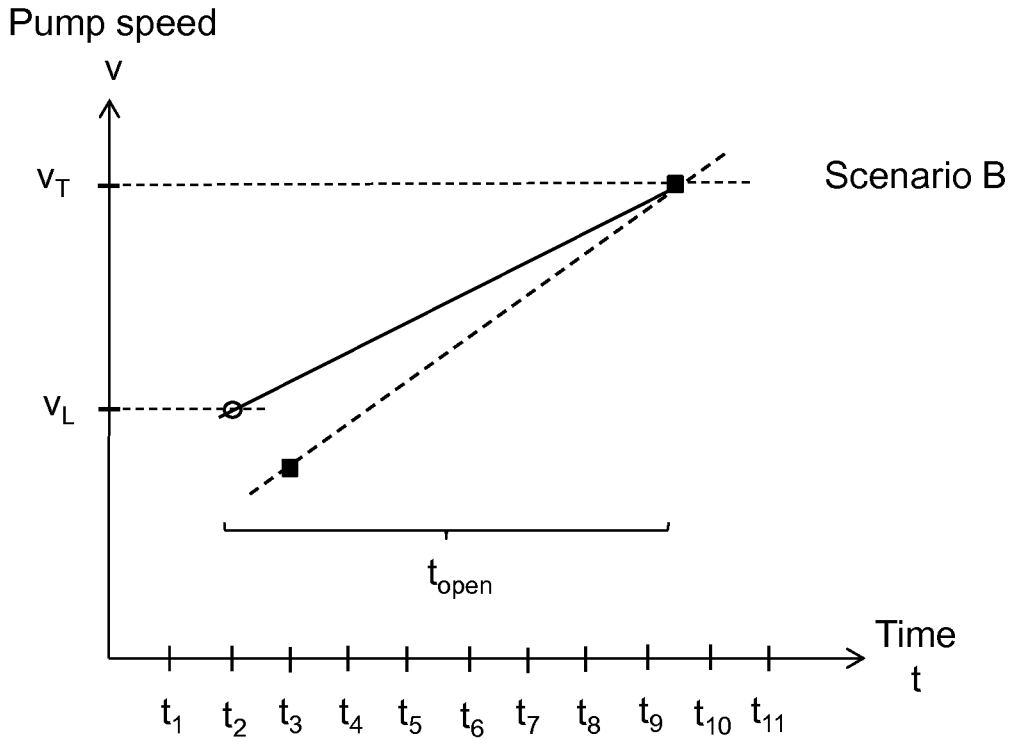
FIG. 7 illustrates another embodiment of estimating the water fill rate in Scenario B of FIG. 4.

Nevertheless, in FIG. 7 it is illustrated that the estimation results in a water fill rate (indicated by means of a continuous line) having a different gradient as compared to that calculated in FIG. 6 (indicated by means of dashed line in FIG. 7).

In a further embodiment, if it would be concluded that the estimated fill rate exceeds a maximum fill rate of the appliance 1, i.e. the maximum fill rate that can be attained given the physical dimensions of the inlet 16 and the valve 15 exemplified in the above to be 2.5 l/min, the estimated fill rate is set to equal the maximum fill rate.

Figure 8:
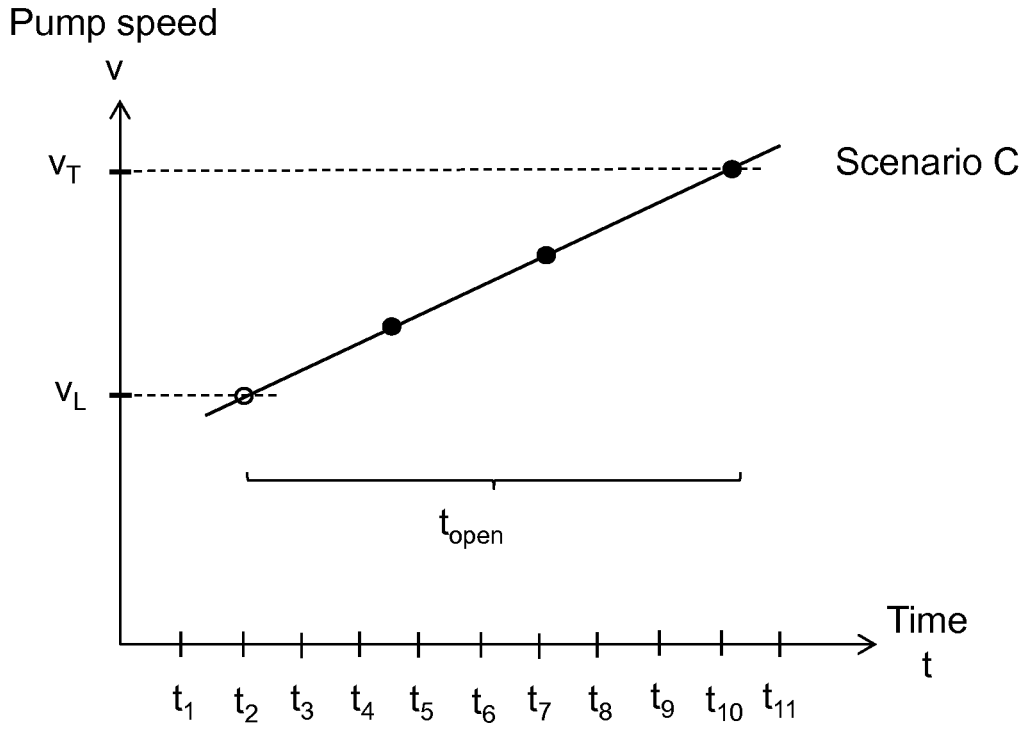
FIG. 8 illustrates an embodiment of estimating the water fill rate in Scenario C of FIG. 4.

FIG. 8 illustrates Scenario C, where all four points are aligned along a straight line. In such a case, the same estimated fill rate would be attained no matter if all or a subset of the points would be used. For instance, an embodiment may be envisaged where all points along the line is used for interpolating an estimated water fill rate, while in another embodiment, only the point representing the lowest speed is used together with the point representing target speed, and all intermediate points are discarded. As can be concluded from FIG. 4, the fill rate of Scenario C would be just slightly below the fill rate of Scenario B estimated in FIG. 7.

In practice, the steps of the method performed by the dishwasher 1 according to embodiments of the invention, is caused by the controller 11 embodied in the form of one or more microprocessors or processing units arranged to execute a computer program 12 downloaded to a suitable storage medium 13 associated with the microprocessor, such as a Random Access Memory (RAM), a Flash memory or a hard disk drive. The controller 11 is arranged to cause the dishwasher 1 to carry out at the steps of the method according to embodiments of the present invention when the appropriate computer program 12 comprising computer-executable instructions is downloaded to the storage medium 13 and executed by the controller 11. The storage medium 13 may also be a computer program product comprising the computer program 12. Alternatively, the computer program 12 may be transferred to the storage medium 13 by means of a suitable computer program product, such as a Digital Versatile Disc (DVD) or a memory stick. As a further alternative, the computer program 12 may be downloaded to the storage medium 13 over a network. The controller 11 may alternatively be embodied in the form of a digital signal processor (DSP), an application specific integrated circuit (ASIC), a field-programmable gate array (FPGA), a complex programmable logic device (CPLD), etc.

The invention has mainly been described above with reference to a few embodiments. However, as is readily appreciated by a person skilled in the art, other embodiments than the ones disclosed above are equally possible within the scope of the invention, as defined by the appended patent claims.

The invention claimed is:

1. A method of estimating water fill rate in an appliance for washing and rinsing goods, comprising:

detecting insufficient circulation pump pressure or insufficient process water flow rate through a circulation pump of the appliance, wherein a sufficient circulation pump pressure and a sufficient process water flow rate correspond to values indicative of a flow to the circulation pump configured to allow normal operation of the circulation pump;

supplying water to a compartment of the appliance;

increasing the speed of the circulation pump from a nonzero speed ($v_L$) to a target pump speed ($v_T$) where the circulation pump pressure or the process water flow rate through the circulation pump has reached a sufficient operational level, the speed being increased at a pace where process water level in a sump of the compartment is maintained or decreased;

logging, upon increasing the circulation pump speed from the nonzero speed ($v_L$) where the insufficient circulation pump pressure or process water flow rate was detected, at least two circulation pump speeds, including time values associated with the at least two circulation pump speeds, and a water supply time period ($t_{open}$) during which the water is supplied to the compartment, wherein at least one of the logged at least two circulation pump speeds is a speed where circulation pump pressure or process water flow rate is insufficient, wherein at least one of the logged at least two circulation pump speeds is the target pump speed ($v_T$), wherein the water supply time period ($t_{open}$) ends when the pump reaches the target pump speed ($v_T$); and estimating the water fill rate based on a predetermined difference in compartment process water volume for the logged at least two speeds and the water supply time period ($t_{open}$).

2. The method of claim 1, wherein the logging of at least two circulation pump speeds further comprises logging at least three circulation pump speeds; and wherein the estimating of the water fill rate further comprises performing an interpolation using the logged at least three circulation pump speeds.

3. The method of claim 1, wherein the logging of at least two circulation pump speeds further comprises:

logging at least three circulation pump speeds, and discarding selected logged circulation pump speeds; and wherein the estimating of the water fill rate comprises:

using at least two remaining circulation pump speeds after the selected logged circulation pump speeds have been discarded.

4. The method of claim 1, wherein if the estimated water fill rate exceeds a maximum fill rate of the appliance, the estimated fill rate is set to equal said maximum fill rate.

5. The method of claim 1, the estimating of the water fill rate further comprising:

acquiring the predetermined compartment process water volumes associated with the logged at least two speeds from a look-up table.

6. The method of claim 1, the detecting of insufficient circulation pump pressure or process water flow rate through a circulation pump of the appliance comprising:

measuring operating current of a motor driving the circulation pump.

7. The method of claim 1, wherein in case no further circulation pump speed at which the circulation pump pressure or process water flow rate is insufficient can be detected upon increasing the speed to the target pump speed, the estimated fill rate is set to equal a maximum fill rate of the appliance.

8. The method according to claim 1, further comprising detecting a sufficient circulation pump pressure or a sufficient process water flow rate immediately before detecting the insufficient circulation pump pressure or the insufficient process water flow rate.

9. An appliance for washing and rinsing goods, comprising:

a circulation pump;

a sensing arrangement configured to measure an indication of circulation pump pressure or process water flow rate through the circulation pump;

an inlet via which water is supplied to a compartment of the appliance; and a controller configured to control operating speed of the circulation pump and to control the supply of water to the compartment, wherein the controller is further configured to:

detect insufficient circulation pump pressure or insufficient process water flow rate through the circulation pump of the appliance, wherein a sufficient circulation pump pressure and a sufficient process water flow rate correspond to values indicative of a flow to the circulation pump configured to allow normal operation of the circulation pump;

supply water to the compartment of the appliance;

increase the speed of the circulation pump from a nonzero speed ($v_L$) to a target pump speed ($v_T$) where the circulation pump pressure or the process water flow rate through the circulation pump has reached a sufficient operational level, the speed being increased at a pace where process water level in a sump of the compartment is maintained or decreased;

log, upon increasing the circulation pump speed from the nonzero speed ($v_L$) where the insufficient circulation pump pressure or process water flow rate was detected, at least two circulation pump speeds, including time values associated with the at least two circulation pump speeds, and a water supply time period ($t_{open}$) during which the water is supplied to the compartment, wherein at least one of the logged at least two circulation pump speeds is a speed where circulation pump pressure or process water flow rate is insufficient, wherein at least one of the logged at least two circulation pump speeds is the target pump speed ($v_T$), wherein the water supply time period ($t_{open}$) ends when the pump reaches the target pump speed ($v_T$); and estimate the water fill rate based on a predetermined difference in compartment process water volume for the logged at least two speeds and the water supply time period ($t_{open}$).

10. The appliance of claim 9, wherein the controller is further configured to, when logging the at least two circulation pump speeds:

log at least three circulation pump speeds; and wherein the controller is further arranged to, when estimating the water fill rate:

perform an interpolation using the logged at least three circulation pump speeds.

11. The appliance of claim 9, wherein the controller is further configured to, when logging the at least two circulation pump speeds:

log at least three circulation pump speeds, and discard selected logged circulation pump speeds; and wherein the controller is further configured to, when estimating the water fill rate:

use at least two remaining circulation pump speeds after the selected logged circulation pump speeds have been discarded.

12. The appliance of claim 9, the controller further being configured to, when estimating the water fill rate:

wherein if the estimated water fill rate exceeds a maximum fill rate of the appliance, the estimated fill rate is set to equal said maximum fill rate.

13. The appliance of claim 9, the controller further being configured to, when estimating the water fill rate:

acquire the predetermined compartment process water volumes associated with the logged at least two speeds from a look-up table.

14. The appliance of claim 9, the sensing arrangement being configured to measure operating current of a motor driving the circulation pump in order to attain the indication of circulation pump pressure or process water flow rate through the circulation pump.

15. The appliance of claim 14, wherein the sensing arrangement comprises:

a resistor arranged at the motor driving the circulation pump, through which resistor operating current of the motor is measured, in order to attain the indication of circulation pump pressure or process water flow rate through the circulation pump.

16. The appliance of claim 9, the controller further being configured to, in case no further circulation pump speed at which the circulation pump pressure or process water flow rate is insufficient can be detected upon increasing the speed to the target pump speed, set the estimated fill rate set to equal a maximum fill rate of the appliance.

17. The appliance of claim 9, said appliance comprising a dish washer or a washing machine.

* * * * *